US011357301B2

(12) United States Patent
Glaser

(10) Patent No.: US 11,357,301 B2
(45) Date of Patent: Jun. 14, 2022

(54) MULTI-COMPARTMENT DEFLATABLE CARRYON BAGGAGE

(71) Applicant: Todd M. Glaser, Miami Beach, FL (US)

(72) Inventor: Todd M. Glaser, Miami Beach, FL (US)

( * ) Notice: Subject to any disclaimer, the term of this patent is extended or adjusted under 35 U.S.C. 154(b) by 605 days.

(21) Appl. No.: 16/202,546

(22) Filed: Nov. 28, 2018

(65) Prior Publication Data

US 2020/0060400 A1 Feb. 27, 2020

Related U.S. Application Data

(60) Provisional application No. 62/720,559, filed on Aug. 21, 2018.

(51) Int. Cl.

| | |
|---|---|
| ***A45C 7/00*** | (2006.01) |
| ***A45C 13/26*** | (2006.01) |
| ***A45C 5/14*** | (2006.01) |
| ***A45C 13/03*** | (2006.01) |
| ***A45C 5/03*** | (2006.01) |
| ***A45C 13/02*** | (2006.01) |

(52) U.S. Cl.

CPC ..... *A45C 7/0045* (2013.01); *A45C 5/03* (2013.01); *A45C 5/14* (2013.01); *A45C 13/03* (2013.01); *A45C 13/262* (2013.01); *A45C 2013/028* (2013.01); *A45C 2013/267* (2013.01)

(58) Field of Classification Search

CPC ..... A45C 7/0045; A45C 5/03; A45C 5/14; A45C 13/03; A45C 13/262; A45C 2013/028; A45C 2013/267

See application file for complete search history.

(56) References Cited

U.S. PATENT DOCUMENTS

| | | | | |
|---|---|---|---|---|
| D671,316 | S * | 11/2012 | Kritzler | A45C 5/14 D3/279 |
| 8,561,769 | B2 * | 10/2013 | Andochick | A45C 7/0045 190/18 A |
| 9,560,901 | B2 * | 2/2017 | Wytenhove | A45C 5/14 |
| 9,648,933 | B2 * | 5/2017 | Munoz | A45C 13/03 |
| 10,694,834 | B2 * | 6/2020 | Logan | A45F 4/02 |

(Continued)

*Primary Examiner* — Tri M Mai

(74) *Attorney, Agent, or Firm* — Trueba & Suarez PLLC; Roberto M. Suarez; William R. Trueba, Jr.

(57) ABSTRACT

Multi-compartment deflatable carryon luggage provides a system with a plurality of bags. The bags can connect to each other and release from each other. When a traveler is packing fewer items, the traveler can detach unneeded bags and only take the bags that are needed. When additional items are needed, more of the bags can be added and connected to each other. In the case of a carryon bag, the bags forming the carryon luggage have a combined size that complies with airline carryon baggage requirements for a single bag. To increase the amount stored in each bag, a deflatable airtight bag is included inside each bag of the luggage. Before being deflated, the deflatable bag has a volume that is greater than the volume of the bag in which the deflatable airtight bag is disposed. After being deflated, the deflatable airtight bag has a volume no larger than the volume of bag in which the deflatable airtight bag is disposed. A pump can be integrated in the luggage. The pump is used to pump the air from the airtight bag after it has been packed.

9 Claims, 6 Drawing Sheets

(56) References Cited

U.S. PATENT DOCUMENTS

| | | | | |
|---|---|---|---|---|
| 2006/0086583 | A1* | 4/2006 | Hoberman | A45C 13/30<br>190/108 |
| 2013/0292221 | A1* | 11/2013 | Ryan | A45C 13/262<br>190/18 A |

* cited by examiner

MULTI-COMPARTMENT DEFLATABLE CARRYON BAGGAGE

CROSS-REFERENCE TO RELATED APPLICATIONS

This application claims the benefit of U.S. Provisional Application No. 62/720,559, filed Aug. 21, 2018, which application is incorporated herein by reference.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to luggage and carryon baggage.

Description of the Related Art

Carryon baggage is the luggage that airlines allow passengers to bring aboard (i.e. not check) an airplane. Airlines set size requirements for carryon baggage to guarantee that all luggage brought into a passenger cabin can fit in the overhead compartments. Current size requirements for carryon luggage are fifty-six centimeters, by thirty-six centimeters, by twenty-three centimeters.

A well-known brand of briefcases, that includes a line of carry-on bags, is sold by Zero Halliburton, Inc. under the trademark ZERO HALLIBURTON.

Vacuum storage bags are plastic bags that have a reopenable airtight closure. A vacuum storage bag can be packed with compressible items like clothing and bedding. Then, the bag is closed. Then, the air is pumped from the bag through a check valve. The check valve is configured to connect to a vacuum cleaner. As the vacuum cleaner sucks the air from the bag, the stored items compress and the volume of the bag decreases.

BRIEF SUMMARY OF THE INVENTION

An object of the invention is to provide multi-compartment deflatable carryon baggage that overcomes the disadvantages of the devices of this general type and of the prior art.

With the foregoing and other objects in view there is provided, in accordance with the invention, baggage, which may be referred to as a bag assembly, that include at least two compartments that latch together. When less storage space is required, only the compartments that are packed are taken and empty compartments are left behind. The compartments connect to each other with latches.

Each compartment of the baggage includes an airtight bag. The airtight bag has an reclosable airtight opening. The airtight bag is connected to a pump built into the luggage wall. The size of the bag is larger than the volume of the compartment before the bag is deflated. After the bag is closed and deflated, the volume of the bag can be deflated to a volume no larger than the volume of the container.

In accordance with the objects of the invention, carryon baggage is provided. The carryon baggage includes a first bag and a second bag. The first bag can be used to hold a first item. When packing space in addition to the first bag is needed, a second bag can be attached to the first bag. A connector is used to releasably connect the second bag to the first bag in a position with an exterior of the first bag abutting the exterior of said second bag. To comply with airline carryon baggage requirements, the first bag and the second bag have a combined length, width, and height when connected that are no larger than an airline limit for a length, width, and height for a single carryon.

To make the carryon baggage easier to transport, the first bag can include an extendable handle and wheels. The second bag would not need a handle and wheels because the handle and wheels of the first bag can be used to transport the second bag, when the second bag is connected to the first bag. The extendable handle has an extended position for towing the baggage. The extendable handle has a retracted position in which the handle is pushed into the first bag. The combined length, width, and height of the first bag and the second bag, including the wheel and the extendable handle in the retracted position are not larger than the airline limit for a length, width, and height for a single carryon.

The carryon baggage can work by stacking the bags. The bags are generally shaped like a rectangular prism having a length, width, and depth. Each of the bags has two dimensions that are the same. For example, the length and width of each of the bags can be equal. The length and width of each bag should be no greater than the airline carryon size limit. In addition, the combined depth of the bags should be no greater than the depth of the airline carryon size limit in order to allow the carryon baggage to qualify as a single carryon.

While the carryon baggage includes at least two bags, the invention encompasses carryon baggage that includes greater numbers of bags. The bags can be stacked by providing a number of bags each with two dimensions that are equal: for example, length and width. The combined third dimension of the number of bags cannot exceed the airline's depth limit for a single piece of carryon luggage.

The connector of the carryon baggage can include a latch, like a tackle box latch. Either the first bag or the second bag can have the latch disposed on it. The other bag can include an edge formed in it. The latch holds the edge to secure the first bag to the second bag.

To prevent the first bag from moving relative to the second bag, a first latch can be placed on the left side of the baggage and a second latch can be place on the right side of the baggage.

The multi-compartment carryon baggage allows a traveler to reduce the traveler's load at times when a single compartment carryon is not full. For example, a traveler on a one-day business trip might need to store one item in the carryon luggage. In such a situation, the traveler would take only one of the bags and detach the other empty ones. As a result, the traveler has reduced the weight and bulkiness of the carryon for that trip. In contrast, on a longer trip, the traveler can pack all of the bags and connect them. The resulting multi-compartment baggage can store as much as a traditional single compartment carryon. The multi-compartment baggage also allows a traveler to pack each compartment for a different day or occasion. Then the traveler only needs to unpack one of the compartments at a time and does not need to unpack and repack the contents of the other containers until the contents are needed.

While the invention is particularly applicable to carryon luggage, the multi-compartment luggage can be used with all sizes of luggage.

Making the carryon bag from a resilient, rigid material can be particularly useful because the rigid shape allows the bags to be latched together tightly and the rigidity prevents play in the connectors that could allow the latches to release.

To increase the storage capacity of each bag, a deflatable airtight bag is placed in each bag. The deflatable bag has a greater volume than the bag when inflated. Air can be pumped from bag, which cause the airtight bag to deflate to a volume that is no larger than the volume of the bag.

Each bag is defines a compartment. In the case of a hard bag with a clamshell design, the bag is made by two compartments that together define the volume of the bag. An airtight bag is connected to one of the compartments. As stated, the airtight bag has a greater volume than a volume of said first compartment and said second compartment combined. An airtight closure, for example a zipper, can be disposed on the airtight bag to open and close the bag. When the bag is unzipped the bag can be loaded or unloaded with items such as clothing. Next, the zipper is closed to make the inner bag airtight. A valve is connected to the airtight bag. The valve allows air to be removed from the airtight bag in order to compress the volume of the airtight bag to a size that is no greater than said volume of said first compartment and said volume of second compartment combined. In this way, the deflated bag now can fit within the luggage. The valve can be a check valve. The check valve allows flow in only one direction. In this case, the check valve allows air to exit the interior bag but not return (i.e. inflow) into the airtight bag.

To remove the air from the airtight bag, a pump is connected to the valve. The pump pulls the air from airtight bag.

The pump can be an integral part of the bag. That is, the pump remains part of the bag even after the airtight bag has been deflated. The pump can be disposed on the same compartment of the bag to which the airtight bag is connected.

The pump can include a bulb that is a hemisphere of flexible resilient material. The pump is actuated by pressing the hemisphere. The hemisphere can be disposed on an exterior surface of the compartment to which the airtight bag is connected.

To protect the pump and to prevent unintentional actuation, the hemisphere can be recessed within the exterior surface of the compartment. The top of the hemisphere can be no taller than level with the outer surface of the compartment.

The first compartment can have an outlet formed therein. The outlet is connected to the valve and allows air that is being removed by the pump to exit from the airtight bag.

A release valve is connected to the airtight bag. The release valve allows air to enter the airtight bag when it is actuated. To open the bag, the vacuum within the airtight bag is first released by operating the release valve. Once the airtight bag has re-inflated. The zipper on the airtight bag can be used to open the airtight bag in order to remove any stored items.

In luggage that includes a plurality of bags, each of the bags can include its own deflatable airtight bag.

Other features that are considered as characteristic for the invention are set forth in the appended claims.

Although the invention is illustrated and described herein as embodied in multi-compartment deflatable carryon baggage, the invention should not be limited to the details shown in those embodiments because various modifications and structural changes may be made without departing from the spirit of the invention while remaining within the scope and range of equivalents of the claims.

The construction and method of operation of the invention and additional objects and advantages of the invention is best understood from the following description of specific embodiments when read in connection with the accompanying drawings.

DETAILED DESCRIPTION OF THE INVENTION

Figure 2:
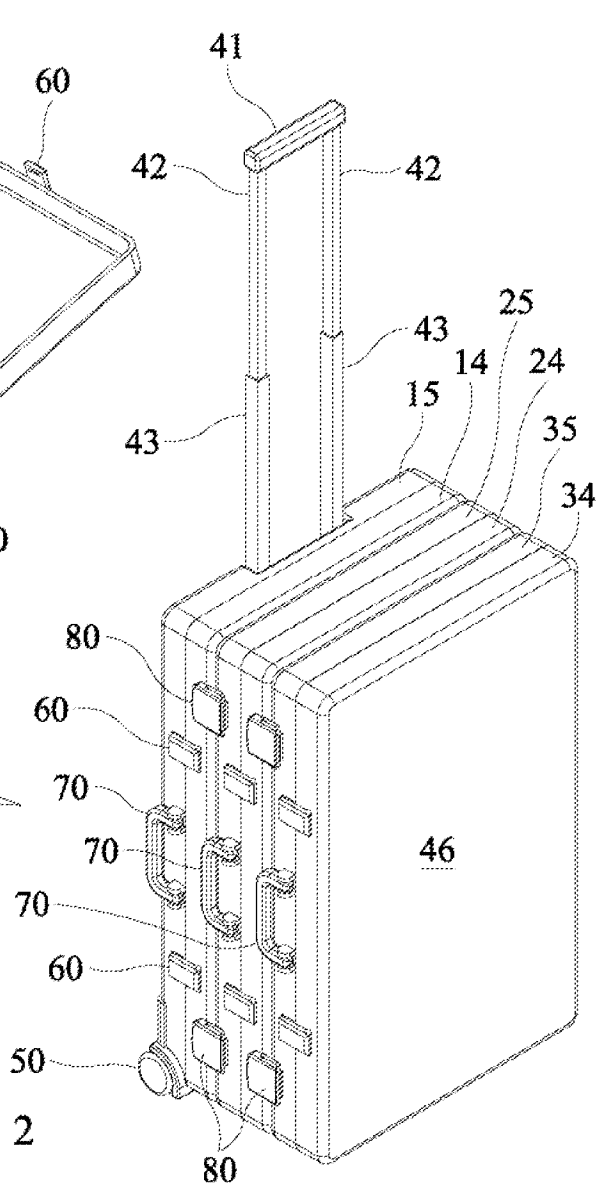
FIG. 2 is a diagrammatic bottom right front perspective view of baggage that includes the compartment shown in FIG. 1.
Figure 1:
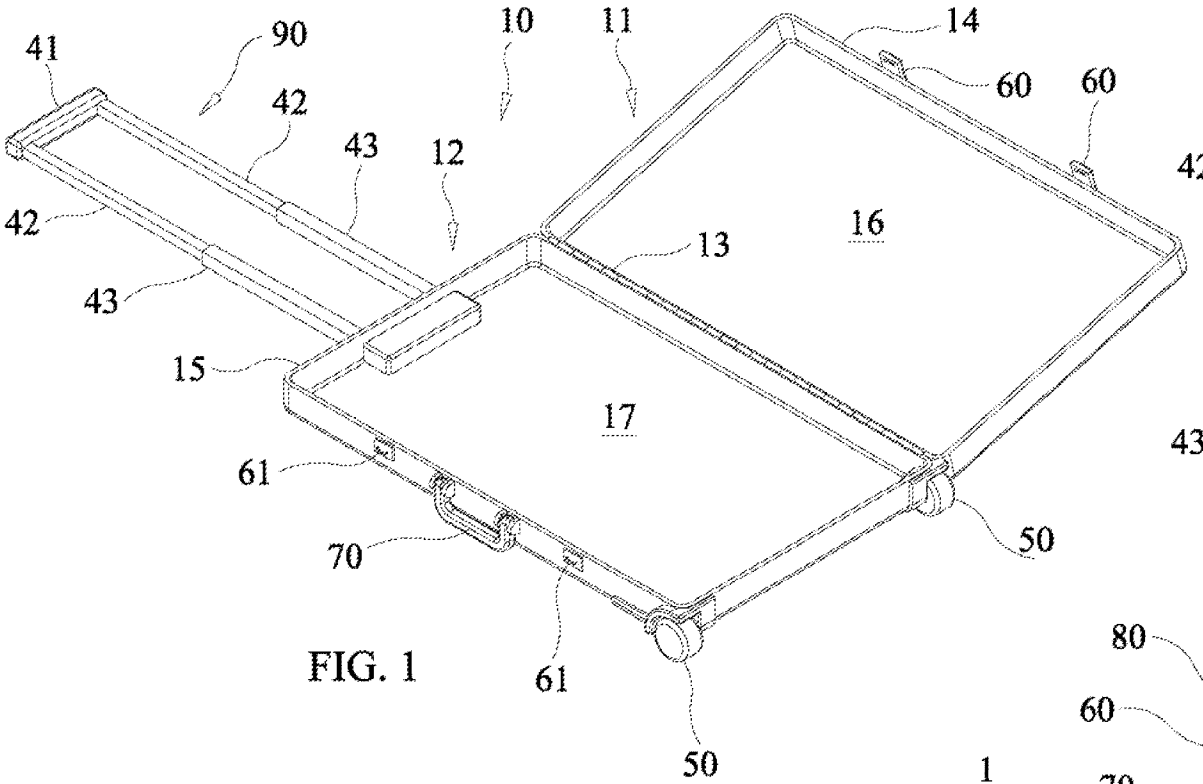
FIG. 1 is a diagrammatic bottom right front perspective view of a baggage compartment according to the invention, which is shown in an open position.
Figure 4:
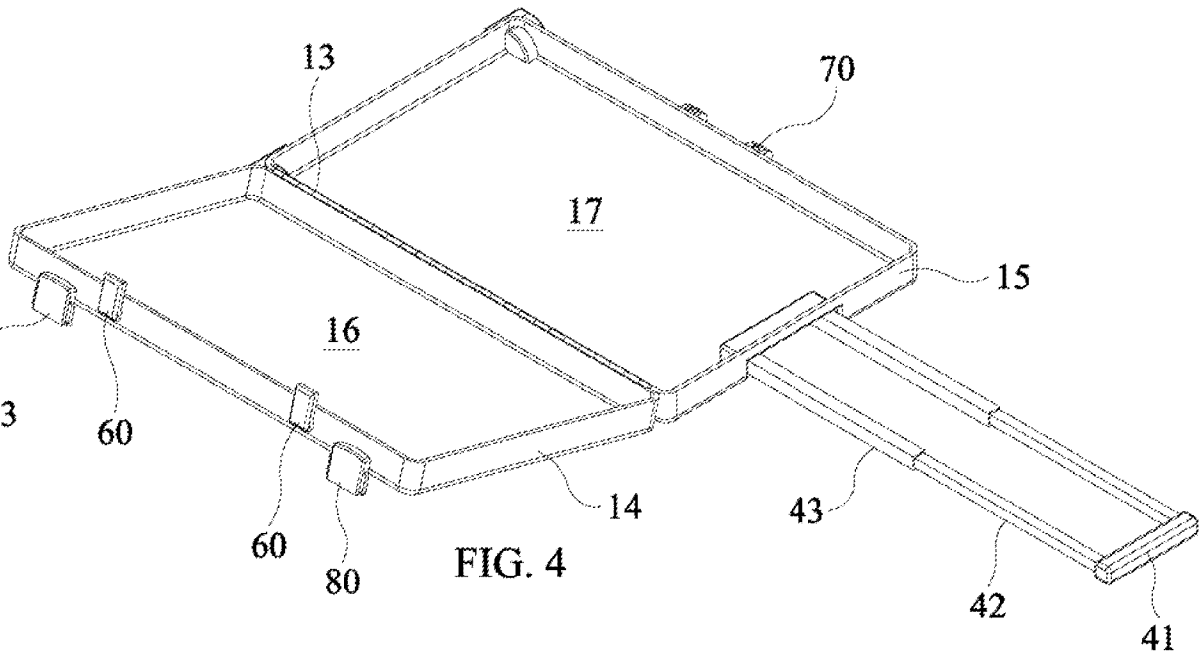
FIG. 4 is a top left front perspective view of the baggage compartment shown in FIG. 1.

FIGS. 1-9 show a preferred embodiment of multi-compartment deflatable carryon luggage 1. The luggage includes a rear bag 10, medial bag 20, and front bag 30.

The rear bag 10 has a front compartment 11 and a rear compartment 12 that open and close along a piano hinge 13. The front compartment 11 includes a front compartment wall 14 and a front panel 16. The rear compartment 12 includes a rear compartment wall 15 and a rear panel 17. The rear compartment wall 15 has a pair of male latches 61 disposed on the rear compartment wall 15. Latches 60 are disposed on the front compartment wall 14. Each latch 60 connects to a respective male latch 61 to close the rear bag 10. A handle 70 is disposed on the rear compartment wall 15 between the male latches 61.

An extendable handle 40 is provided in the rear bag 10. The handle 40 includes a grip 41. Inner telescoping segments 42 extend and retract into outer telescoping segments 43.

Wheels 50 are disposed on the bottom of the rear compartment 12 of the rear bag 10.

The medial bag 20 has a front compartment 21 and a rear compartment 22 that open and close along a piano hinge 23. The front compartment 21 includes a front compartment wall 24 and a front panel 26. The rear compartment 22 includes a rear compartment wall 25 and a rear panel 27. The rear compartment wall 25 has a pair of male latches 61 disposed on the rear compartment wall 25. Latches 60 are disposed on the front compartment wall 24. Each latch 60 connects to a respective male latch 61 to close the medial bag 20. A handle 70 is disposed on the rear compartment wall 25 between the male latches 61.

The front bag 30 has a front compartment 31 and a rear compartment 32 that open and close along a piano hinge 33. The front compartment 31 includes a front compartment wall 34 and a front panel 36. The rear compartment 32 includes a rear compartment wall 35 and a rear panel 37. The rear compartment wall 35 has a pair of male latches 61 disposed on the rear compartment wall 35. Latches 60 are disposed on the front compartment wall 34. Each latch 60 connects to a respective male latch 61 to close the medial bag 30. A handle 70 is disposed on the rear compartment wall 35 between the male latches 61.

Figure 6:
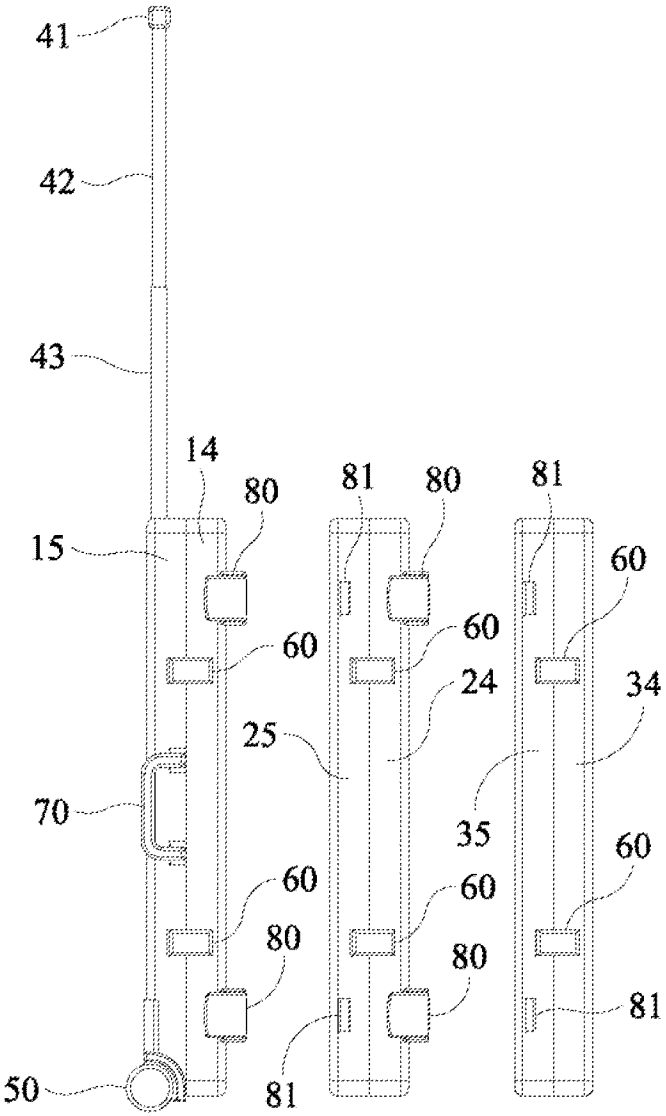
FIG. 6 is a right elevational view of the baggage shown in FIG. 5, with the compartments detached from each other.
Figure 5:
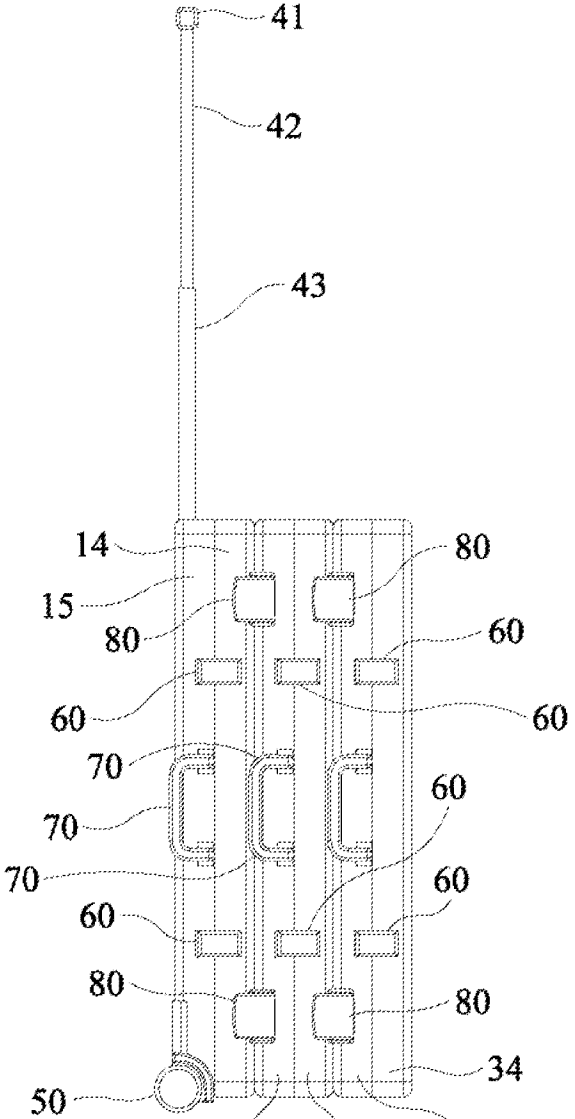
FIG. 5 is a right elevational view of the baggage shown in FIG. 2.

As shown in FIGS. 5-6, the rear bag 10, medial bag 20, and front bag 30 can be attached and released to each other. The rear bag 10 has latches 80 disposed on the right and left portions of the front compartment wall 14. Each latch 80 engages with a respective edge 81 on the rear compartment wall 25 of the medial bag 20. Similarly, the medial bag 20 has latches 80 disposed on the right and left of the front compartment wall 24. Each latch 80 engages with a respective edge 81 on the rear compartment wall 35 of the front bag 30.

Figure 3:
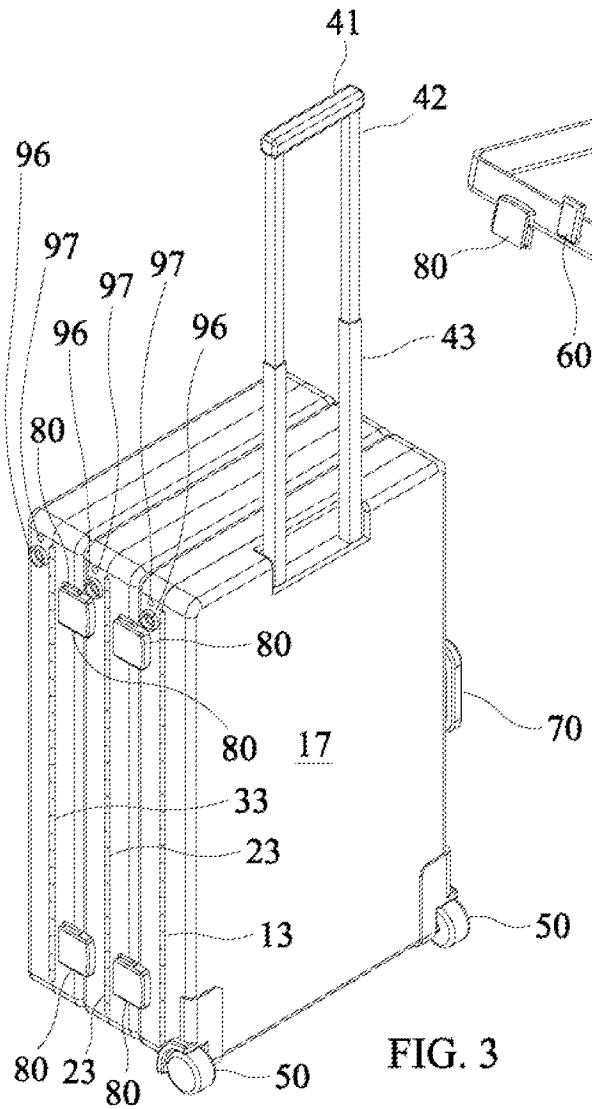
FIG. 3 is a top, left, rear perspective view of the baggage shown in FIG. 2.
Figure 7:
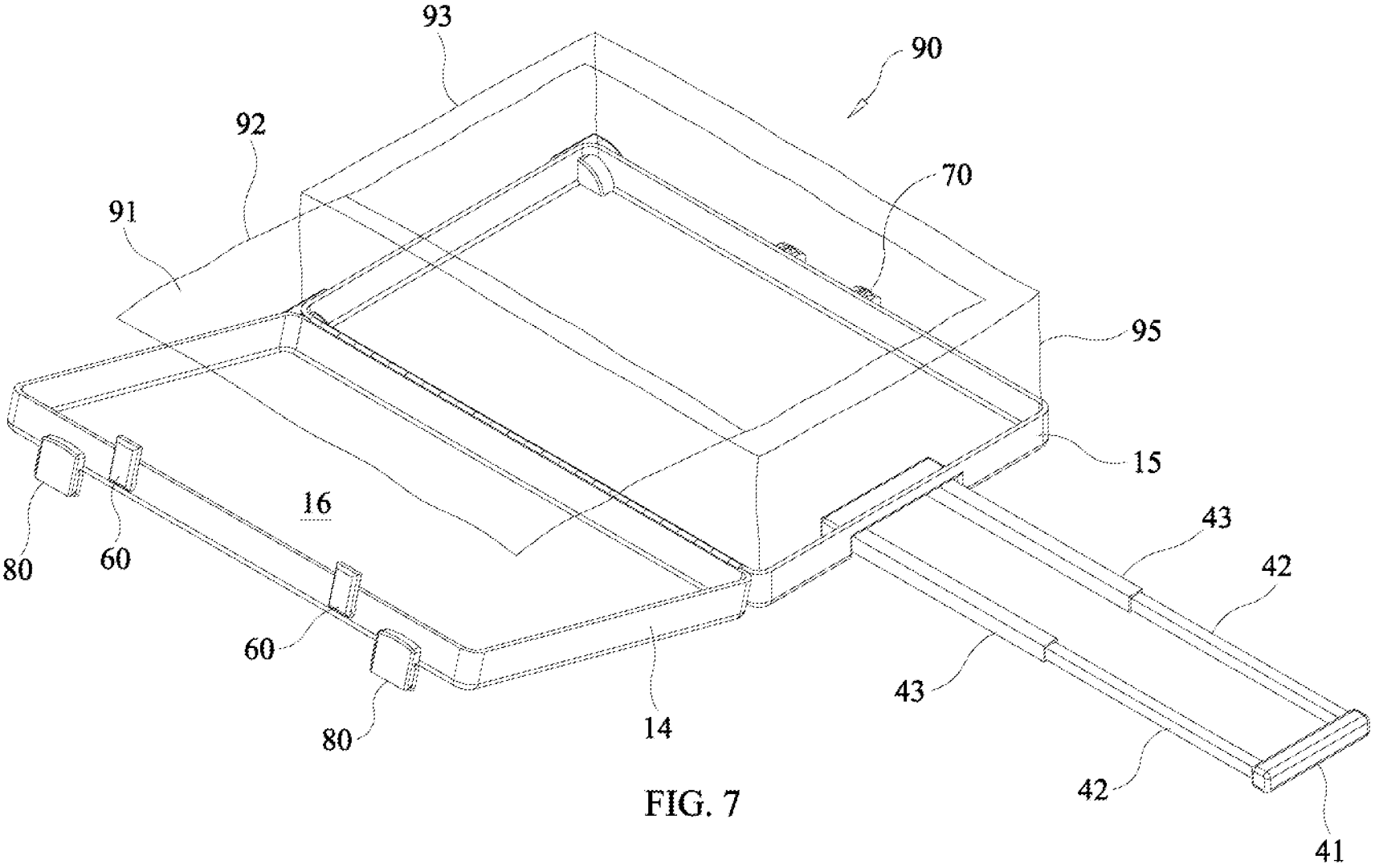
FIG. 7 is a left, top, front perspective view of baggage compartment shown in FIG. 1 that includes an inner bag in an opened, inflated position.
Figure 8:
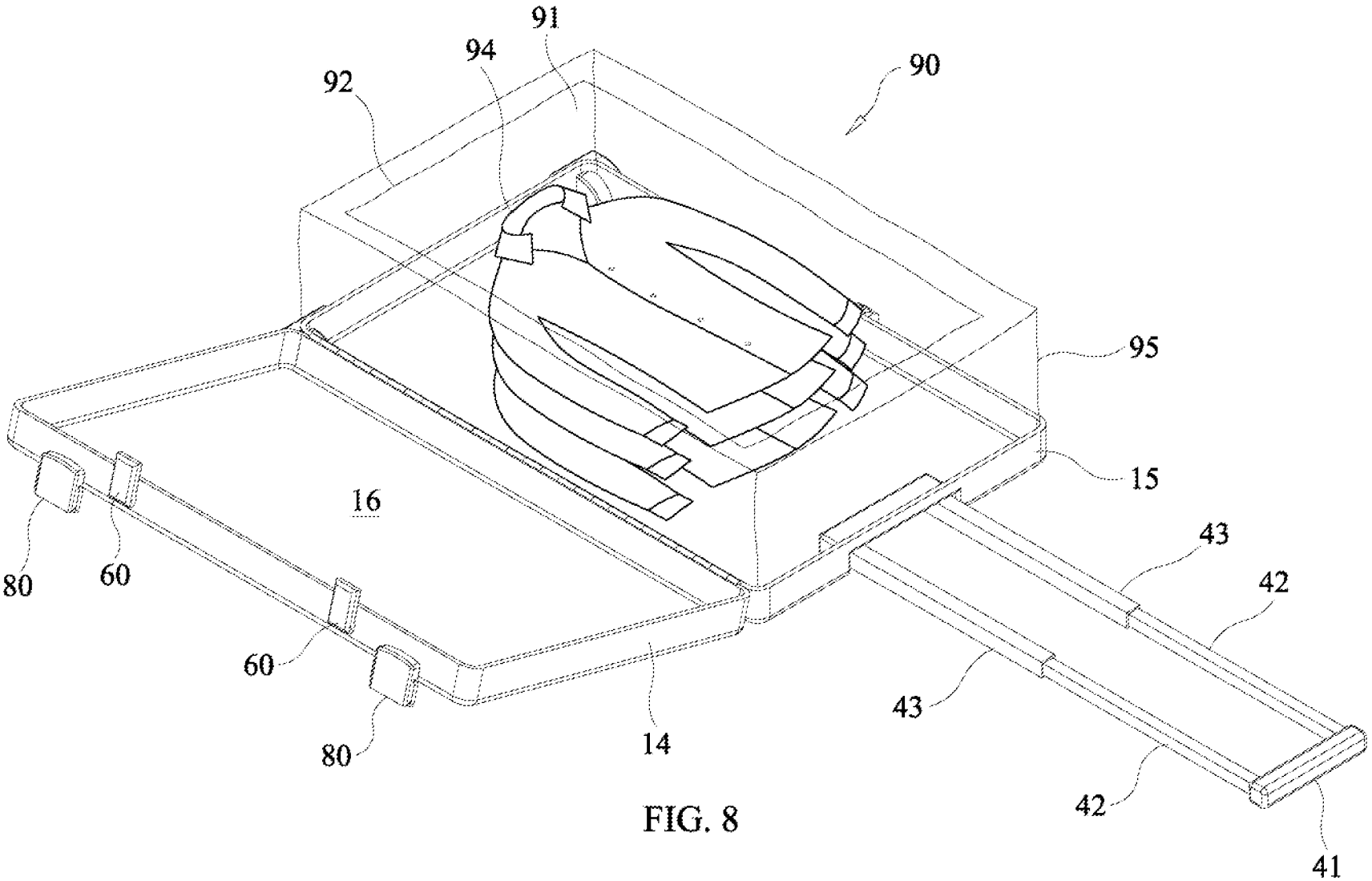
FIG. 8 is a left, top, front perspective view of the baggage compartment shown in FIG. 7 that is packed with garments and has its flap closed.
Figure 9:
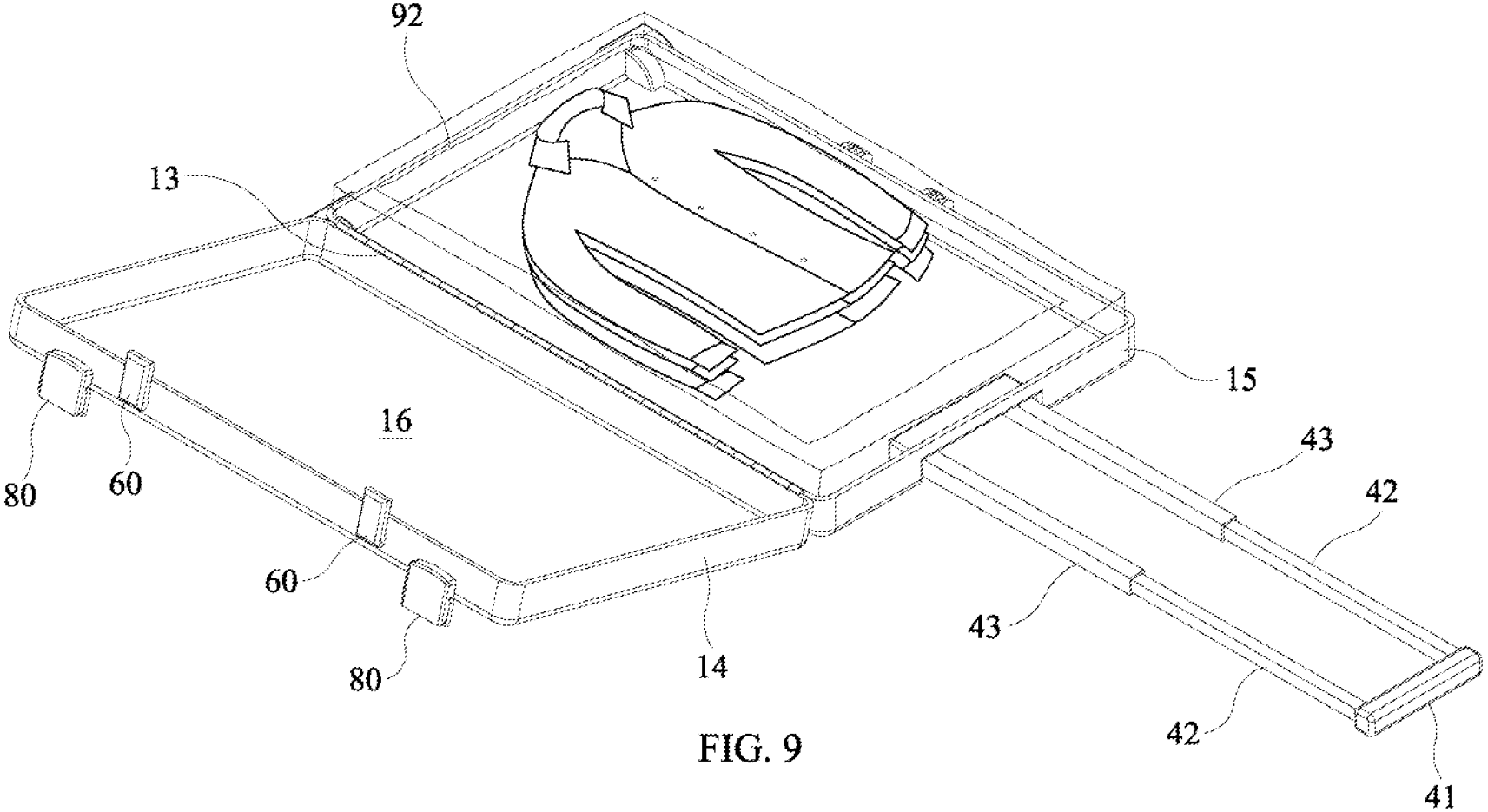
FIG. 9 is a left, top, front perspective view of the baggage compartment shown in FIG. 8, with the inner bag in a compressed, deflated condition.

FIGS. 7-9 illustrate the deflatable aspect of each bag 10, 20, and 30. A bag 90 is connected to the rear panel 17. The bag 90 has a volume that is great than the rear bag 10 when the bag 90 is filled and not yet deflated as shown in FIG. 8. In FIG. 8, clothes 94 are loaded in the bag 90. The flap 91 is closed. An airtight zipper 92 closes the bag 90. A pump 96 is connected to the bag 90. The pump 96 is shown in FIG. 3. When the pump 96 is pressed, air is pumped from the bag 90 and out the air outlet 97. A check valve in the air outlet 97 prevents air from returning into the bag 90. The pump 96 has a release, which allows air to refill the bag 90. FIG. 9 shows the bag 90 including the clothes 94 in a compressed state. In the compressed state, the deflated bag 90 has a volume no greater than the volume of the rear bag 10.

What is claimed is:

1. Carryon baggage, comprising:

a first bag for holding a first item;

a second bag for holding a second item;

wherein each of the first bag and the second bag comprise:

an exterior;

an interior with a first compartment and a second compartment that open and close along a hinge, and together define a volume of the first bag and the second bag;

an inflatable/deflatable airtight bag connected to the first compartment, the airtight bag having a greater volume than a volume of the first compartment and the volume of the second compartment combined, when inflated;

an airtight closure disposed on the inflatable/deflatable airtight bag for opening and closing the inflatable/deflatable airtight bag to allow an item to be inserted and removed;

a valve connected to the inflatable/deflatable airtight bag allowing air to be removed from the inflatable/deflatable airtight bag to compress the volume of the inflatable/deflatable airtight bag to less than the combined volume of the first compartment and the second compartment;

a pump disposed on the first compartment and being connected to the valve, the pump comprising a hemisphere of flexible resilient material, the pump removing air from the inflatable/deflatable airtight bag when actuated by pressing the hemisphere of flexible resilient material;

wherein the hemisphere of resilient material is recessed within an outer surface of the first compartment and does not extend beyond the outer surface; and a connector for releasably connecting said second bag to said first bag in a position with said exterior of said first bag abutting said exterior of said second bag;

said first bag and said second bag having a combined length, width, and height when connected, said combined length, width and height being no larger than an airline carryon size limit for a length, width, and height for a single carryon, according to current airline carryon baggage requirements, for allowing the combined first bag and second bag to qualify as a single carryon.

2. The carryon baggage according to claim 1, wherein said first bag has an extendable handle and a wheel, said extendable handle having an extended position for towing said first bag, said extendable handle having a retracted position; said combined length, width, and height including said wheel and said extendable handle in said retracted position being no larger than the airline carryon size limit for a length, width, and height for a single carryon.

3. The carryon baggage according to claim 1, wherein:

said first bag has a length, a width, and a height;

said second bag has a length, a width, and height;

a first and a second of said length, said width, and said height of said first bag equaling a first and a second of said length, said width, and said height of said second bag;

said first and said second of said length, said width, and said height of said first bag being no larger than a first and a second of a length, a width, and a height of the airline carryon size limit;

said first and said second of said length, said width, and said height of said second bag being no larger than a first and a second of a length, a width, and a height of the airline carryon size limit; and a sum of a third of said length, said width, and said height of said first bag and a third of said length of said length, said width, and said height of said second bag being no larger than a third of the length, the width, and the height of the airline carryon size limit.

4. The carryon baggage according to claim 1, further comprising:

an edge formed on one of said first bag and said second bag; and wherein the connector comprises a latch formed on the other of said first bag and said second bag, said latch releasably connecting to said edge.

5. The carryon baggage according to claim 4, wherein:

said edge is formed on a left side of said one of said first bag and said second bag;

said latch is formed on a left side of said other of said first bag and said second bag;

a further edge is formed on a right side of one of said first bag and said second bag; and a further latch is formed on a right side of the other of said first bag and said second bag.

6. The carryon baggage according to claim 1, wherein said first compartment has an outlet formed therein, said outlet being connected to said valve and allowing air to exit from the airtight bag.

7. The carryon baggage according to claim 1, wherein said valve is a check valve, said check valve allowing air to exit from said airtight bag and preventing air from entering said airtight bag.

8. The carryon baggage according to claim 1, further comprising a release valve connected to said airtight bag, said release valve allowing air to enter said airtight bag when actuated.

9. The carryon baggage according to claim 1, further comprising a release valve connected to said airtight bag, said release valve allowing air to enter said airtight bag when actuated.

* * * * *